US005383267A

United States Patent [19]

Plunkett

[11] Patent Number: 5,383,267

[45] Date of Patent: Jan. 24, 1995

[54] APPARATUS FOR CENTERING AN ACTUATOR COIL

[75] Inventor: Bradley J. Plunkett, Granada Hills, Calif.

[73] Assignee: Harman International Industries, Inc., Northridge, Calif.

[21] Appl. No.: 116,672

[22] Filed: Sep. 7, 1993

[51] Int. Cl.[6] ..... H04R 31/00

[52] U.S. Cl. ..... 29/705; 29/593; 29/594; 29/732

[58] Field of Search ..... 29/594, 593, 606, 705, 29/732, 759; 381/197

[56] References Cited

U.S. PATENT DOCUMENTS

| | | | |
|---|---|---|---|
| 3,619,434 | 11/1971 | Blastic et al. | 29/594 X |
| 4,010,536 | 3/1977 | Fujita et al. | 29/593 |
| 4,312,118 | 1/1982 | Saik et al. | 29/592 |
| 5,235,291 | 8/1993 | Shiga | 29/593 X |

*Primary Examiner*—Carl E. Hall
*Attorney, Agent, or Firm*—J. E. McTaggart

[57] ABSTRACT

An automatic method for optimizing coil/gap centering in the manufacture of an electro-magnetic actuator or transducer such as a loudspeaker or microphone eliminates the use of shims. Capacitance measurements between the coil and adjacent magnet poles are utilized to evaluate and optimize concentricity of the coil and its bobbin in the magnetic gap prior to finally affixing the flexible suspension member(s) such as the spider and/or surround to the actuator mainframe, typically by adhesive bonding around the outer edge of the suspension member(s). Optimal concentricity corresponds with the minimum capacitance reading found from a series of capacitance measurements at different locations of the coil assembly within the constraints of interference between the coil with its bobbin and the pole pieces. This principle may be utilized in a work station that constrains the mainframe portion while automatically moving the coil assembly laterally in a search pattern to acquire the concentric location corresponding to minimum capacitance so that the suspension can be affixed to a portion of the mainframe, typically by adhesive bonding, with the coil concentricity thus optimized. Capacitance measurement can further serve as a valuable quality control test: requiring the minimized capacitance to fall below a statistically based limit provides assurance that the coil is correctly shaped and oriented and is optimally centered.

2 Claims, 2 Drawing Sheets

APPARATUS FOR CENTERING AN ACTUATOR COIL

FIELD OF THE INVENTION

The present invention relates to the manufacture of electromagnetic actuators of the type having a vibratory tubular coil in a magnetic gap, as exemplified by audio transducers, loudspeakers and the like. More particularly it relates to an automatic method, in the original manufacture of an actuator, for sensing and optimizing the concentricity of the coil in the gap prior to permanently affixing the coil assembly.

BACKGROUND OF THE INVENTION

Typically the final operation in the production of electromagnetic actuators involves inter-positioning and affixing together two main portions: a stationary mainframe portion and a vibratable coil assembly. The mainframe portion includes a magnetic system having a magnet, yoke and polepieces defining a gap, all rigidly incorporated with the mainframe as a common mass. The gap is typically formed in an annular shape between a cylindrical pole piece and a surrounding polepiece that defines a circular opening. The coil assembly includes a tubular coil, known in a loudspeaker as the voice coil, typically wound on an insulating bobbin and located in the magnetic gap, and also includes suspension means for providing lateral constraint to keep the coil concentric in the gap while leaving it free to vibrate axially. Typically a suspension member known as a spider, attached around the coil form, provides a peripheral attachment region that is designed to be adhesively bonded to a corresponding portion of the mainframe in the final assembly process. In a typical loudspeaker there is also a second suspension member known as a surround, attached around the outer edge of the conical diaphragm; the surround has a peripheral attachment region that is designed to be adhesively bonded to a surrounding region of the mainframe in the final assembly process.

In manufacturing the actuator, the coil assembly is initially positioned to place the coil and its bobbin in the magnetic gap: it is then positioned as accurately as possible for concentricity, then held in this optimal location during the curing cycle of the adhesive bonding agent applied between the attachment regions of the suspension member(s) and the mainframe attachment region(s). The accuracy of this final positioning operation is critical for the performance and reliability of the actuator since the concentricity becomes fixed upon bonding, with no way of subsequent readjustment. Sufficient clearance margin must be provided in this positioning operation to tolerate some degree of dimensional or shape change over time that could allow unacceptable contact between the coil or bobbin and a metal pole surface.

A common manufacturing practice has been to manually insert a set of shims of selected thickness between the bobbin and the cylindrical pole piece, leaving them in place until the bonding agent sets. Then, after the shims are removed, a cover member may be adhesively fixed in place over the central region of the diaphragm as a dust seal. Once this is done there is normally no satisfactory way of directly inspecting the finished unit in the factory or later in the field to verify the concentricity or the margin of reserve clearance available: functional testing may reveal instances where there is actual contact but fails to provide any quantitative evaluation of the margin of clearance.

When the bobbin is improperly shaped (out-of-round) or tilted due to improper attachment to the coil assembly, shimming temporarily forces the coil into proper shape and orientation, however when the shims are removed after suspension attachment, the bobbin reverts to its misshape or tilted orientation with the result that the clearance may be reduced to the point of incipient failure even though the actuator may appear to function normally.

There is an unfulfilled need for an automatic method of locating the coil assembly, in preparation for final affixing, without the use of shims so that the coil can rest free in its inherent orientation while it is being optimally centered. This implies the requirement for not only a new method of sensing and optimizing the concentricity during final assembly, but also for a new method of quantitatively evaluating the concentricity that can detect physical anomalies such as out-of-round or tilted coils.

RELATED PRIOR ART

U.S. Pat. No. 4,312,118 to Saik et al discloses a shim gauge inserted through a hollow central hole pole piece for voice coil centering in the air gap.

U.S. Pat. No. 3,619,434 to Blastic discloses a method of adjusting the airgap of an electric transducer in final assembly, utilizing a variable DC bias along with an AC test signal to optimize the air gap before adhesively fixing the assembly.

U.S. Pat. Nos. 2,431,841 to Storm and 4,397,078 to Imahashi are of interest in illustrating capacitive techniques of measuring gap distance or material thickness directed to fields other than transducer coil concentricity.

OBJECTS OF THE INVENTION

It is a primary object of the present invention to provide an automatic method and associated apparatus for sensing coil concentricity in a magnetic gap of an electromagnetic actuator and accordingly positioning coil suspension members for optimal coil concentricity prior to bonding the suspension members to the mainframe and thus permanently fixing the coil location in the gap.

It is further object to extend the utility of the aforementioned method to include a quality control measurement indicative of coil/gap concentricity of the finished actuators which have been assembled in accordance with the primary object of the invention.

SUMMARY OF THE INVENTION

The present invention utilizes measurements of capacitance between the coil and the nearby metallic magnetic pole structure of an electromagnetic actuator in order to evaluate the concentricity of the coil in the magnetic gap, and, in manufacture, to thus optimize the concentricity in the final assembly procedure where the suspension members are adhesively bonded to the mainframe. Since optimal concentricity coincides with minimum capacitance, the desired location can be determined from a series of capacitance measurements at different locations; the coil assembly can then be moved to the desired location and the suspension affixed to the mainframe at this location, typically by adhesive bonding.

This capacitive sensing principle is utilized in a work station that retains the mainframe while moving the coil assembly in a search pattern from which data is analyzed to obtain the optimal concentric location, where the assembly is then affixed in place.

The same setup can be utilized following the suspension bonding to evaluate the coil/gap concentricity and coil integrity of a finished actuator: a measurement of the absolute value of capacitance, as previously minimized, can serve to verify that the coil is concentric in the gap, correctly shaped and correctly oriented.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
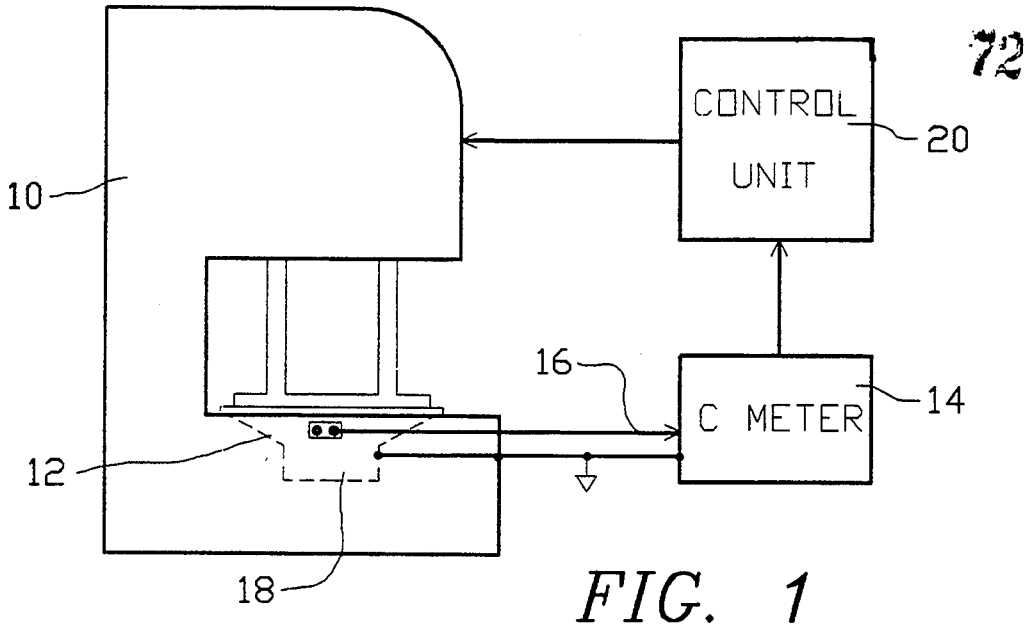
FIG. 1 is a block diagram showing a manufacturing station for automatically positioning an actuator coil assembly relative to a mainframe portion in accordance with the method of the present invention.

FIG. 1 is a block diagram showing, as an illustrative example of the present invention, a positioning machine 10 acting on a loudspeaker 12, as an example of an actuator in manufacture. Machine 10 includes clamping means for securing the mainframe of loudspeaker 12 in a horizontal orientation as shown, and positioning means for supporting the voice coil assembly at a predetermined normal vertical level and for moving it around relative to the mainframe of the loudspeaker, in a horizontal plane, to any location within the limits imposed by interference between the voice coil and adjacent pole surfaces. A capacitance measuring instrument 14, grounded to the mainframe and having its measurement probe 16 connected to at least one of the two voice coil terminals 18, measures the capacitance and provides the result as input to a control unit 20, typically microprocessor based, which controls machine 10.

Figure 2:
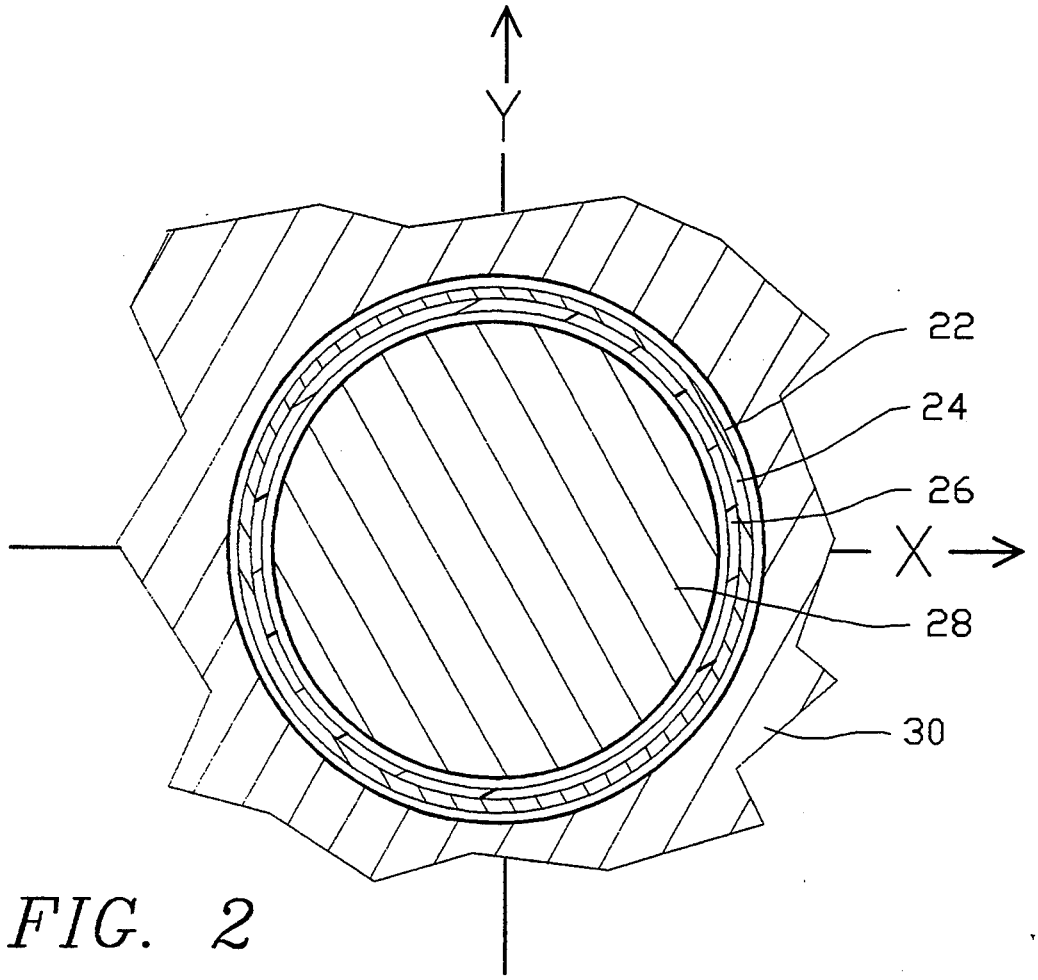
FIG. 2 is a cross-sectional view of a coil located in an annular magnetic gap of an actuator.

FIG. 2 is a cross-section of a coil assembly 22, which includes a bobbin 24 and coil winding 26, to be centered between a center pole 28 and a surround pole 30 of the loudspeaker. Also shown are X and Y axes in which the voice coil assembly 22 can be shifted by the machine 10 of FIG. 1. Coil winding 26 may be single- or multiple-layered; typically two layers are utilized in loudspeaker voice coils.

Figure 3:
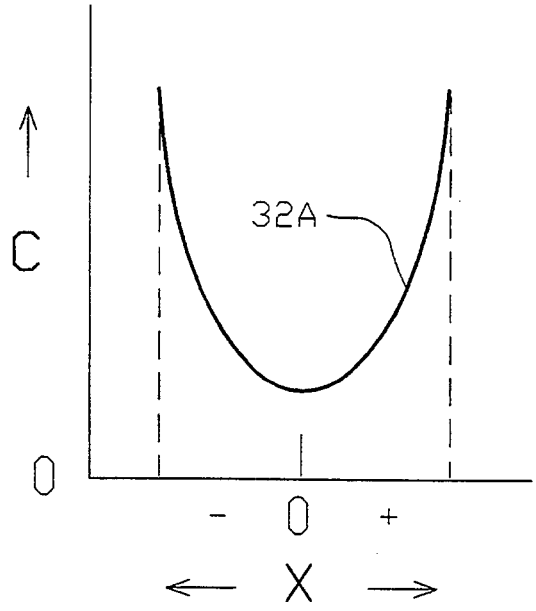
FIG. 3 is a graph of capacitance as a function of coil positioning relative to magnetic pole pieces along the X axis.
Figure 4:
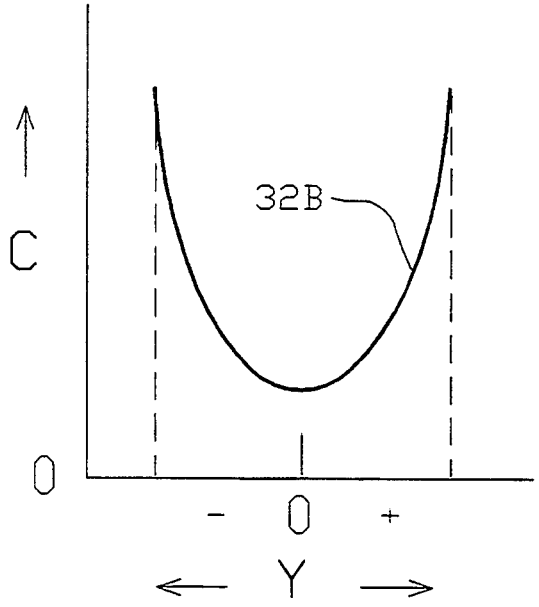
FIG. 4 is a graph of capacitance as a function of coil positioning relative to magnetic pole pieces along the Y axis.

FIGS. 3 and 4 are graphs in which curves 32A and 32B indicate the measured capacitance C as a function of coil positioning in the X and Y axes respectively. In each case the capacitance reaches a minimum value in a centered position between the two limits of constraint, where the coil is uniformly spaced from the pole structure. The capacitance increases to a maximum value when the coil is shifted off center in any direction to the limit of constraint, the constraint being due to mechanical interference between a portion of the coil or its bobbin and the magnetic pole structure.

Referring again to FIG. 1, in a preferred automatic embodiment of the present invention, control unit 20 is set up to cause the machine 10 to move the coil assembly in both X and Y directions in a predetermined search pattern while monitoring and registering a series of capacitance readings. These are analyzed by control unit 20 to determine the location at which the capacitance value reaches a minimum, i.e. the optimal concentric location; then finally machine 10 is commanded by control unit 20 to relocate the coil assembly to this optimal concentric location and to hold it there in place while the suspension is permanently affixed to the mainframe, typically by adhesive bonding around the outer edge(s) of the suspension member(s).

As an alternative to the above described automatic embodiment, machine 10 could be made to provide the required coil movement manually: in such a manual device the function of control unit 20 would be performed by a human operator observing the reading on C-meter 14 while moving the coil assembly around in a search pattern until a minimum capacitance value is obtained. At that point, the suspension is held in place and permanently affixed in the same manner as described above for the automatic embodiment.

The foregoing process requires only relative capacitance values of relatively low accuracy; however the absolute value of the minimum capacitance that is available in either the automatic or the manual methods described above may be measured with appropriate accuracy to yield useful quality control information regarding the integrity of the actuator being assembled. A capacitance reading falling below a specified limit verifies (a) that the coil location is optimized concentrically in the gap and (b) that the coil is correctly shaped and (c) that it is correctly oriented. A capacitance reading falling above the specified limit indicates a mechanically defective actuator unit, most probably due to a shortcoming in item (a), (b) and/or (c).

The absolute capacitance reading is also valuable as a quality assurance measurement that may be readily performed on finished actuators in the field or warehouse as well as in manufacturing to provide useful insight, heretofore unavailable, regarding the quality and condition of the actuator. This measurement would not require machine 10 or any special holding fixture; it would require only that the actuator terminals be accessible for proper connection to the capacitance-measuring instrument. Of course overall validity depends on instrument accuracy, correct measurement technique and judicious designation of acceptance limits, typically based on statistical analysis of historical data from comparable actuator units.

While the above descriptions have described an illustrative embodiment wherein the present invention is practiced with a loudspeaker as the workpiece, the underlying principle of the invention may be readily applied to practically any form of electro-magnetic actuator such as a microphone or other transducer having a vibratable tubular coil in a magnetic gap.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. Automatic manufacturing apparatus for final relative positioning and affixing together of two major portions of an electro-magnetic moving coil actuator, the portions being (1) a mainframe portion incorporating a magnet system having an annular gap formed between a cylindrical pole piece and a surrounding pole piece, and (2) a coil assembly including a tubular coil disposed in the gap and associated suspension means having an edge region intended to be affixed to a corresponding region of the mainframe portion for laterally constraining the coil in a final permanent concentric location in the gap, the apparatus, comprising:

a holding mechanism for retaining the mainframe portion and the coil assembly positioned in a pre-final interrelationship;

a powered mechanism, cooperating with said holding mechanism, provided with capability of positioning the coil assembly relative to the main frame portion in a lateral plane to an extent bounded by interference between the coil and the pole pieces;

capacitance-measuring means connected to sense capacitance between the coil and a common ground node electrically connected to the pole pieces; and a control unit enabled to command said powered mechanism to sequentially position the coil assembly to a series of predetermined locations, to acquire data from said capacitance-measuring means for each of the locations, to analyze the data so as to determine therefrom a minimum capacitance value, and to finally relocate the coil assembly to a location corresponding to the minimum capacitance;

whereby the coil assembly may then be affixed to the mainframe assembly such that the coil is suspended concentrically in the gap.

2. The automatic manufacturing apparatus as defined in claim 1 wherein said control unit is provided with capability of comparing the minimum capacitance value with a predetermined reference limit capacitance value as a quality control criteria, whereby an actuator having a minimum value exceeding the limit value may be identified and diverted as substandard for coil/gap concentricity.

* * * * *